United States Patent [19]

Greig

[11] Patent Number: 4,708,369

[45] Date of Patent: Nov. 24, 1987

[54] MULTIPLE PLY, ALTERATION-INHIBITED STOCK FOR A MATCH-THE-HIDDEN-INDICIA GAME

[75] Inventor: Walter G. Greig, Lewiston, N.Y.

[73] Assignee: Moore Business Forms, Inc., Glenview, Ill.

[21] Appl. No.: 877,499

[22] Filed: Jun. 23, 1986

[51] Int. Cl.[4] ..... B42D 15/00; B42D 5/00

[52] U.S. Cl. ..... 283/108; 283/903

[58] Field of Search ..... 283/108, 903; 156/52 A, 156/52 AL; 40/2 R, 65; 428/40; 224/108; D21/1, 51

[56] References Cited

U.S. PATENT DOCUMENTS

| | | | |
|---|---|---|---|
| 1,985,834 | 12/1934 | Lawrence . | |
| 2,300,787 | 11/1942 | Ingliss . | |
| 3,631,617 | 1/1972 | Pekko | 283/108 |
| 3,854,229 | 12/1974 | Morgan . | |
| 3,891,242 | 6/1975 | Arnold et al. . | |
| 3,900,219 | 8/1975 | D'Amato et al. . | |
| 4,082,873 | 4/1978 | Williams | 283/108 |
| 4,174,857 | 11/1979 | Koza . | |
| 4,278,199 | 7/1981 | Tanaka . | |
| 4,506,916 | 3/1985 | Kuhl . | |
| 4,512,581 | 4/1985 | Levine . | |
| 4,591,190 | 5/1986 | Clark | 283/903 |

FOREIGN PATENT DOCUMENTS

| | | | |
|---|---|---|---|
| 768040 | 9/1967 | Canada | 283/903 |
| 2075918 | 11/1981 | United Kingdom | 283/903 |

*Primary Examiner*—E. R. Kazenske
*Assistant Examiner*—Paul M. Heyrana, Sr.
*Attorney, Agent, or Firm*—Cushman, Darby & Cushman

[57] ABSTRACT

Each unit of the stock for a match-the-hidden-indicia game includes a base sheet printed on one face with a visually ascertainable pattern of indicia, and a cover sheet also printed on one face with a visually ascertainable pattern of indicia which may or may not match the pattern on the base sheet. The one face of the base sheet on at least a band including the pattern of indicia, is provided with a transparent coating of permanent adhesive, and a liner layer is facially adhered thereto. The relative attraction of the permanent adhesive for the one surface of the base sheet and the liner layer is such that any attempt to remove the liner layer will substantially disrupt the one surface, thus giving evidence of an attempt to tamper with the pattern of indicia on the base sheet. The cover sheet is temporarily facially bonded to the liner layer or base sheet in such a way as to obscure the pattern of indicia on the base sheet from view until the temporary bonding of the cover sheet to the liner layer is disrupted, e.g. by peeling or tearing it away.

6 Claims, 2 Drawing Figures

MULTIPLE PLY, ALTERATION-INHIBITED STOCK FOR A MATCH-THE-HIDDEN-INDICIA GAME

BACKGROUND OF THE INVENTION

A popular game which variously is used for amusement, or in connection with advertising and promotion of a product or service, or as a game of chance, is a multiple-ply match the hidden indicia game. According to the generic concept of this game as conventionally available, the potential player is presented with a unit of game stock which is made of a lamination of at least two facially adhered webs of sheet material. The one face of the base web is printed with a visually ascertainable pattern of indicia, whether it be numbers, letters, other verbal symbols, non-verbal symbols, or series or combination of any of these. A face of the cover web also is printed with a visually ascertainable pattern of indicia, and the two webs are laminated together in such a way that the pattern of indicia on the one face of the base web is obscured. The potential player, upon coming into possession of a unit of the stock of such a game delaminates the two plies in order to ascertain whether the pattern of indicia provided on the cover ply bears a predetermined relationship to, e.g. is the same as, or complements or otherwise matches the pattern of indicia provided on the base ply.

In an ideal world where all game agents and players could be expected to be scrupulously honest, no means for guarding against fraudulent alteration of the game stock would be necessary. However, in the world which exists, it has been found to be advantageous if not essential to provide means for guarding against such fraudulent alteration, so that the theoretical number of winners, their distribution and the amount of prizes to be won will not exceed those which can be predicted from full knowledge of the game stock.

Drawbacks of priorly-existing concepts of stock for use in conducting and playing such games include that the stock cannot be printed with variable information using modern non-impact printing apparatus and techniques, and/or that lamination and/or delamination of the plies involves exposure of a pressure sensitive adhesive, which may foul printing or laminating apparatus, or may make premature discovery of the hidden indicia difficult to prevent and/or difficult to detect.

SUMMARY OF THE INVENTION

Each unit of the stock for a match-the-hidden-indicia game includes a base sheet printed on one face with a visually ascertainable pattern of indicia, and a cover sheet also printed on one face with a visually ascertainable pattern of indicia which may or may not match the pattern on the base sheet. The one face of the base sheet on at least a band including the pattern of indicia, is provided with a transparent coating of permanent adhesive, and a liner layer is facially adhered thereto. The relative attraction of the permanent adhesive for the one surface of the base sheet and the liner layer is such that any attempt to remove the liner layer will substantially disrupt the one surface, thus giving evidence of an attempt to tamper with the pattern of indicia on the base sheet. The cover sheet is temporarily facially bonded to the liner layer or base sheet in such a way as to obscure the pattern of indicia on the base sheet from view until the temporary bonding of the cover sheet to the liner layer is disrupted, e.g. by peeling or tearing it away.

The principles of the invention will be further discussed with reference to the drawing wherein a preferred embodiment is shown. The specifics illustrated in the drawing are intended to exemplify, rather than limit, aspects of the invention as defined in the claims.

DETAILED DESCRIPTION

Figure 1:
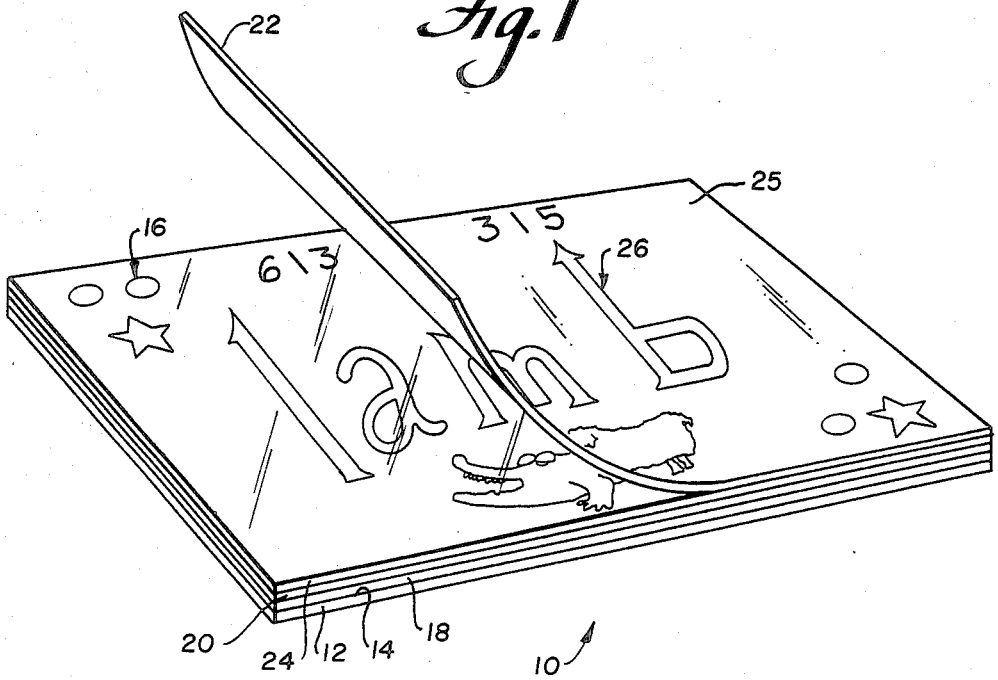
FIG. 1 is a perspective view of a unit of game stock embodying principles of the present invention.

The product provided in accordance with a preferred practice of the principles of the present invention is stock for participation in a game of the like, typified by the unit 10.

The unit 10 is shown including a base sheet 12, on one face 14 (e.g. the upper face) of which is printed a pattern of indicia 16, in this instance represented by the word "lamb", a pattern of two disks and a star in an upper left corner, a number "613" located generally medially of the upper margin, and a picture of an alligator located medially of the lower margin.

Applied on the one face 14 so as to cover the pattern of indicia 16, is a layer of clear i.e. transparent, permanent adhesive 18. Adhered facewise on the one face 14 of the base sheet 12 by means of the adhesive 18 is a layer 20 of transparent lining material.

According to a principle of the present invention, the relative attraction of the adhesive 18 for the base sheet 12 is so strong relative to the attraction of the adhesive 18 for the lining layer 20, and for the base sheet 12 with its own one surface 14, that any attempt made to peel the lining layer 20 off of the one surface 14, i.e. so as to gain access to the pattern of indicia 16 for altering or previewing it, will cause at least partial yet significant disruption of the surface 14 relative to the base sheet 12, so that tampering or attempted tampering will be evident.

Applied on the base sheet 12 so as to cover the pattern of indicia 16 on the one face 14 of the base sheet 12, is a cover sheet 22 made of opaque material.

The cover sheet 22 is connected to the base sheet 12 so as to cover the pattern of indicia 16, by means of a layer of temporary bonding material 24.

The cover sheet 22 bears on its one face 25 a pattern of indicia 26, in this instance represented by the word "lamb", a pattern of two disks and a star in a lower right corner, a number "315" located generally medially of the upper margin, and a picture of a lamb located medially of the lower margin.

When a game participant receives the unit 10, whether by purchase, by acceptance as a gift or promotional item or the like, the pattern of indicia 16 on the base sheet 12 is entirely obscured by the cover sheet 22, and the cover sheet 22 is so thoroughly or effectively connected to the base sheet by means of the temporary bonding material 24, that the game participant holding the unit 10 of game stock cannot make a visual comparison of the pattern of indicia 26 with the pattern of indicia 16, until the cover sheet 22 is removed from the base sheet 12 by disruption of the bond provided by the temporary bonding material 24. The cover sheet could be die cut or perforated to define the area which should be removed. Temporary bonding material will not allow the cover sheet to be reattached. The use of printing and perforations on the cover sheet would also provide additional security.

In FIG. 1, the cover sheet 22 is shown in the process of being pulled away from the base sheet 12, so as to expose the pattern of indicia 12 for comparison with the pattern of indicia 26.

The rules for winning the game may vary and be subject to selection by the organization which is conducting the game. For instance, in order to win, it may be necessary for the pattern of indicia 16 to be identical to the pattern of indicia 26, or it may be necessary for no element of one to be identical to the corresponding element of the other. Matching the patterns can involve looking for identity, looking for lack of identity, looking for limited identity, looking for like placement or existence of various fields of indicia, complements, mirror images, and so forth.

Figure 2:
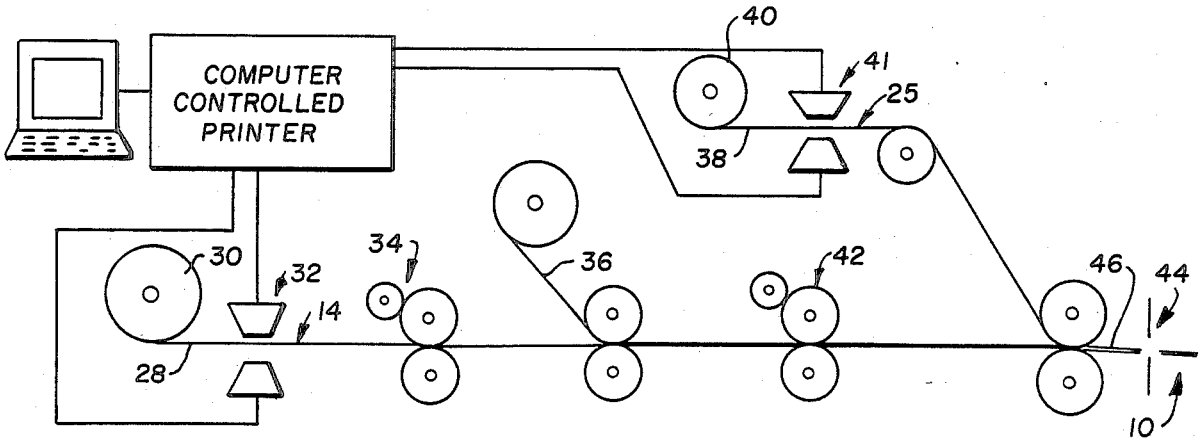
FIG. 2 is a schematic diagram of a production line for making the product shown in FIG. 1.

A typical but simplified production line for preparing units 10 of the game stock is shown in FIG. 2. In actual practice, the manufacturing process may be carried out in several series of steps on different production lines, and/or partially in a discontinuous manner, rather than in the one continuous series of steps that is shown.

In the production process as depicted, a web 28 of base sheet stock is unrolled at 30 and advanced through a printing station 32 at which it is provided with printing, including a printing on one face 14 of the web with a succession of patterns of indicia 16 (not shown in this Figure), at least one for each succeeding region of the web 28 that will become one unit of the game stock.

At a subsequent station 34 through which the printed web 28 is forwarded, a layer of permanent adhesive is provided on the one face 14 and a web 36 or succession of sheets of lining material is adhered by means of the adhesive to the one face 14 of the web 28 in such a way as to provide a tamper-proof cover for the fields of indicia 16, yet permit those fields to be observed therethrough. (In practice, the permanent adhesive can be applied to either the one face of the base sheet web, or to the face of the lining material which is to be adhered facewise thereto.)

Meanwhile, a web 38 of cover sheet stock is unrolled at 40 and advanced through a printing station 41 at which it is provided with printing, including a printing on one face 25 thereof with a succession of patterns of indicia 26 (not shown in this figure), at least one for each succeeding region of the web 38 that will become one unit of the game stock.

At a subsequent station 42 through which the webs 28 and 38 are forwarded, a layer of temporary bonding material is applied to one of these webs and the two are brought together, i.e. are collated and sealed, in such a way that the cover web 38 is held on the base web, by the temporary bonding material 24, in obscuring relation to the patterns of indicia 16.

At a subsequent station 44, the resulting continuous stock 46 may be transversally perforated and folded or rolled up to provide a series of units 10 which may be field-severed into individual units, or successive increments may be severed at the station 44 from the leading end of the continuous stock 46 to be furnished to the game-conducting organization.

If, due to the nature of the game it is also necessary to guard the pattern of indicia 26 on the cover sheet from being viewed prior to tearing of the cover sheet away from the base sheet, the pattern of indicia 26 may be provided on that face of the cover sheet which faces towards the one face 14 of the base sheet 12, rather than on an always-exposed face of the cover sheet.

If, due to the nature of the game it is also necessary to protect the pattern of indicia 26 on the cover sheet 22 against alteration, this may be accomplished e.g. by laminating a transparent layer of lining material (not shown), to the printed face of the cover sheet 22, using a permanent adhesive (not shown) as has been described hereinabove in regard to the pattern of adhesive 16 on the base sheet 12.

In practice the printing stations 32 and 41 may be co-located, or at least controlled from a common control station 50, e.g. one which aids in determining when e.g. how frequently, a cover sheet will be provided with a pattern of indicia that, when collated with a base sheet provided with a pattern of indicia will constitute a unit having matching indicia. Some or all of the printing provided at one printing station or the other may be constant from one unit to the next, or relatively non-varying. It is within the contemplation to print all of the printing using the same printing machine, e.g. a laser printer or other non-impact printer, or to print some or all of the non-varying printing with one printing machine, and the remainder, including the varying printing, with another printing machine. One or both faces of the base and cover sheets may be printed upon. Either face of either sheet may also include printing which is not part of the respective pattern of indicia.

The borders of the cover sheet of each unit need not be coterminous with the borders of the respective base sheet, so long as the pattern of indicia on the base sheet is effectively covered by the cover sheet until it is permissible for the pattern of indicia on the base sheet to be revealed. The edges of the two sheets may be coterminous, or one, two or three may be and the other or others not, or the cover sheet may be a patch lying entirely within the borders of the base sheet, or the cover shet may constitute a partial or complete wrapper for the base sheet, or an envelope which contains the base sheet.

Correspondingly, the temporary bonding material 24 may be constituted by a layer of temporary adhesive by means of which the lining layer is disconnectably adhered facewise to the inner face of the cover sheet, or it may be in the form of marginal strips of adhesive by means of which a strip or patch-type of cover sheet is marginally secured on the lining layer on the base sheet, or it may be in the form of wrapper or enveloping sheet material and adhesive connecting that wrapper or enveloping sheet material to itself or any other element of the unit.

A wide range of sheet materials and adhesives are available for making the product of the invention. In one preferred practice of the invention, the various elements are made of the following materials:

| Element | Exemplary Material |
|---|---|
| base sheet stock (12) | paper |
| transparent permanent adhesive (18) | acrylic emulsion Rohm & Haas - N 619 |
| transparent lining material (20) | clear plastic film, e.g. polyethylene |
| temporary bonding material (24) | fugitive binder, e.g. polyvinyl acetate modified with wax or molecular wt. polyethylene |
| cover sheet stock (22) | card stock paper |

It would be effectively impossible to list all of the material which could be substituted for those given in the above example. However, for further assisting those skilled in the art to understand how the principles of the invention may be put into practice, the following further examples are given:

As elaborations on the preferred embodiment which has been shown and described, the cover sheet 22 could be die cut and/or perforated to define a flap or patch wholly within its borders or contiguous with one or more of its edges, in order to define a region which is to be lifted or removed in order to expose the hidden indicia. The breaking of perforations would supplement the non-reattachment characteristic of the temporary bonding material 24 for prevention of undetected tampering. Of course, printing on the cover sheet 22 also can be relied upon as a supplementary means for preventing premature detection of the hidden indicia.

Although the various layers, e.g. of adhesive on paper have been described as if there is no interpenetration, it should be understood that in some instances a layer, e.g. of an adhesive may exist partly or even mostly within another layer, e.g. as a fugitive adhesive, rather than solely on an external surface of such other layer. Unless otherwise indicated, the use of the terms 'on' and 'coating' as used herein in relation to the juxtaposition of contacting layers are not meant to exclude such interpenetration of layers, e.g. to form a combined adhesive and liner element.

The present invention is aware that other have provided so-called piggyback labels (whether the term is used generically or as a trademark is not known), which may be similar in structure to the stock of the present invention, but which are meant to be used for labeling and not for a hidden indicia-type of game. In that sense, the inventor believes he has devised a new, nonanalogous use for piggyback label stock.

It should now be apparent that the multiple ply, alteration-inhibited stock for a match-the-hidden-indicia game as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A game stock comprising at least one unit, each said unit of game stock comprising:

a base sheet;

a first pattern of indicia printed on one face of said base sheet;

a layer of transparent permanent adhesive material adhered on said one face of said base sheet so as to cover said first pattern of indicia;

a layer of transparent lining material secured on said one face of said base sheet by means of said adhesive material so as to cover said first pattern of indicia;

said base sheet, adhesive material and lining material being so adapted that an attempt to gain access to said first pattern of indicia by removal of said layer of transparent lining material from an overlying, protective relationship thereto, will result in substantial, visually apparent disruption of said first pattern of indicia in relation to said one face;

a cover sheet of opaque material;

a second pattern of indicia printed on one face of said cover sheet; and a temporary bonding material disconnectably holding said cover sheet on said base sheet in obscuring relationship to said first pattern of indicia.

2. A game stock according to claim 1, comprising:

a plurality of said units of game stock, as to which, in only a predetermined number of instances which is less than all, the first pattern of indicia on a unit matches the second pattern of indicia on that unit.

3. The game stock according to claim 2, wherein:

said units are provided as successive elements in a series on a web thereof, from which such units may be successively detached.

4. The game stock of claim 1, wherein:

said temporary bonding material is constituted by a layer of temporary adhesive which adheres said cover sheet facewise on said layer of transparent lining material.

5. The game stock of claim 3, wherein:

said temporary adhesive is adapted to remain behind on said layer of transparent lining material as said cover sheet is removed therefrom to reveal said first pattern of indicia.

6. The game stock of claim 1, wherein:

said one face of said cover sheet is an outer face thereof, wherefore said second pattern of indicia is exposed on said unit even while said temporary bonding material is disconnectably holding said cover sheet on said base sheet in obscuring relationship to said first pattern of indicia.

* * * * *